US005556014A

United States Patent [19]

Kolton et al.

[11] Patent Number: 5,556,014

[45] Date of Patent: Sep. 17, 1996

[54] HANGER COMPOSITE FOR DISPLAY OF NECKTIES WITH PREFORMED KNOTS

[75] Inventors: Chester Kolton, Westfield; Stuart S. Spater, Livingston, both of N.J.

[73] Assignee: B&G Plastics, Inc., Newark, N.J.

[21] Appl. No.: 366,606

[22] Filed: Dec. 29, 1994

Related U.S. Application Data

[63] Continuation-in-part of Ser. No. 180,045, Jan. 11, 1994, Pat. No. 5,421,494.

[51] Int. Cl.[6] ..... A47G 25/14; A47G 25/74

[52] U.S. Cl. ..... 223/85; 223/88; 206/292

[58] Field of Search ..... 2/149, 150, 152.1, 2/153; 223/85, 88, 92, 95; D6/315; 206/289, 292

[56] References Cited

U.S. PATENT DOCUMENTS

| | | | |
|---|---|---|---|
| 2,391,661 | 12/1945 | Watkins et al. | 223/88 |
| 4,416,401 | 11/1983 | King | 223/88 |
| 4,453,655 | 6/1984 | Smilow et al. | 223/87 |
| 5,029,739 | 7/1991 | Blanchard et al. | 223/88 |
| 5,222,638 | 6/1993 | Kolton et al. | 223/87 |

*Primary Examiner*—Bibhu Mohanty
*Attorney, Agent, or Firm*—Robin, Blecker, Daley & Driscoll

[57] ABSTRACT

A hanger composite includes a first hanger including a tail having first and second portions folded about a tail fold area to define a tail loop, the first tail portion having a latching opening therethrough, the second tail portion having a projection extending outwardly thereof and resident in the latching opening, and a second hanger having a portion thereof disposed retentively within the tail loop, the second hanger having a second portion disposed outwardly of the tail loop and adapted for hanging an article.

13 Claims, 4 Drawing Sheets

HANGER COMPOSITE FOR DISPLAY OF NECKTIES WITH PREFORMED KNOTS

CROSS-REFERENCE TO A RELATED APPLICATION

This application is a continuation-in-part of U.S. patent application Ser. No. 08/180,045, filed on Jan. 11, 1994, and entitled "HANGER COMPOSITE FOR DISPLAY OF PLURAL ARTICLES", now U.S. Pat. No. 5,421,494.

FIELD OF THE INVENTION

This invention relates generally to hangers for article display and pertains more particularly to a hanger composite for display of neckties preformed with knots.

BACKGROUND OF THE INVENTION

Najarian U.S. Pat. No. 4,337,539 discusses a well-known necktie knot support assembly having a molded plastic part (the necktie knot former) and a metal spring member secured to the plastic part for joinder with the collar of a shirt.

Folding tail belt hangers are depicted in U.S. Pat. Nos. 3,710,996 and 4,063,669, to which incorporating reference is made. The former patent discloses a hanger for the hanging of belts having buckles with prongs. The latter patent, while specific to the further disclosure of the hanging of belts having buckles with studs, shows both belt hanging facilities. In hanging belts having buckles with prongs both patents employ a foldable tail with a projection on one side of the fold line and a latching recess for the projection on the other side of the fold line. The extent of the projection outwardly of the tail, apart from an enlarged free end portion thereof, is of extent corresponding to the thickness of the foldable tail, such that the facing tail portions adjacent the latching recess and the projection abut one another.

In the application parent hereto above referenced, applicants herein noted that the known folding tail hangers theretofore had use only in the hanging of belts. In the parent application, applicants expanded the facilities of such hangers. More particularly, they looked to the use of the known hangers for the display also of an article used, e.g., promotionally, in the sale of a belt.

In such facility expansion, applicants provided a hanger composite including a first hanger having a hook portion for releasable securement to a display rod and an elongate foldable tail portion, the tail portion defining a latching opening therethrough and a projection extending outwardly of the tail portion to a given extent for latching disposition in the latching opening, and a second hanger assembled with the first hanger and defining a compartment for containment of an article, the second hanger having an opening therethrough configured complementally with the tail portion of the first hanger and enabling the assembly of the first and second hangers.

The first hanger defined a belt buckle prong receiving opening in the tail portion, the tail portion preferably being configured to dispose the second hanger distal from the belt buckle prong receiving opening. The second hanger desirably defined a fold line aside the second hanger opening, whereby the second hanger may be adjusted such that the belt and the second hanger are disposed in vertically parallel manner.

SUMMARY OF THE INVENTION

The present invention has as its primary object further expanding the use of the known folding tail hangers.

Specifically, the invention has as an objective the provision of folding tail hangers for use in hanging neckties with preformed knots.

A further object of the invention is the provision of improved folding tail hangers.

A particular object in the latter respect is to equip the known hangers with capacity for imparting orientation to neckties with preformed knots thereby hung.

In attaining the outset stated object, the invention elongates the projection so as to enable it to function, in addition to securing the fold of the tail, to support an article to be hung from the tail.

In attaining the second stated object, the invention disposes a portion of the spring member of a necktie knot support assembly within the fold of the tail, and has the elongated projection supporting the necktie knot support assembly.

Attainment of the third and fourth stated objects is discussed hereinafter.

The foregoing and other objects and features of the invention will be further evident from the following detailed description of preferred embodiments thereof and from the drawings in which like components are identified by like reference numerals throughout.

DETAILED DESCRIPTION OF PREFERRED EMBODIMENTS AND PRACTICES

Figure 1:
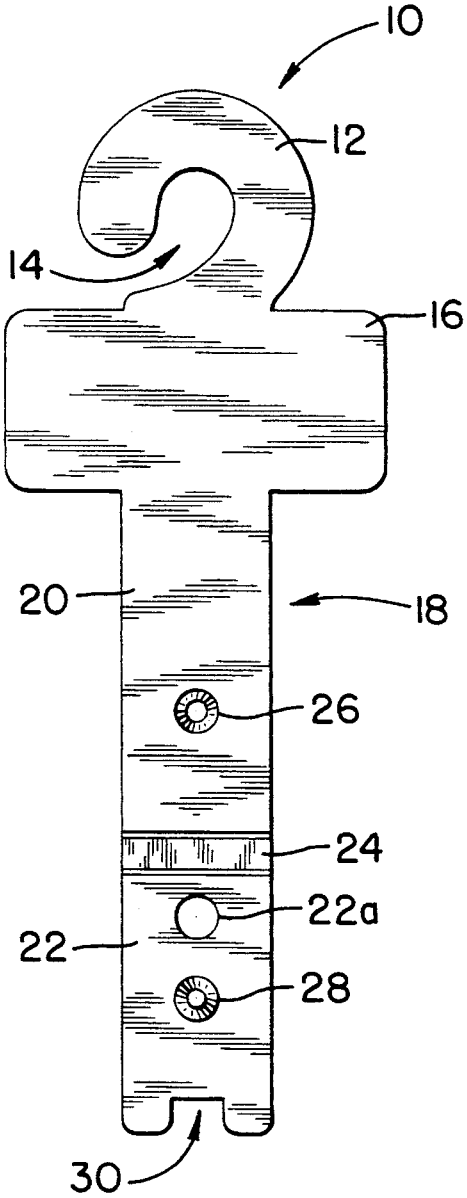
FIG. 1 is a front elevation of a folding tail hanger in accordance with the invention.
Figure 4:
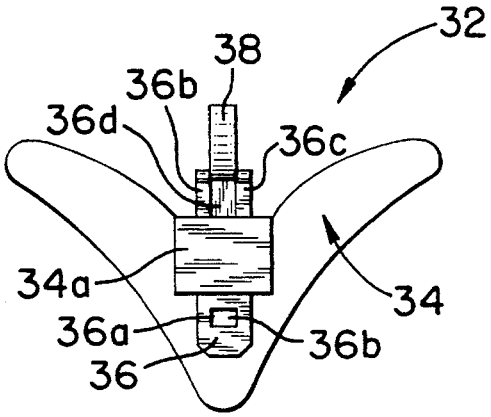
FIG. 4 is front elevation of a necktie knot support assembly.
Figure 5:
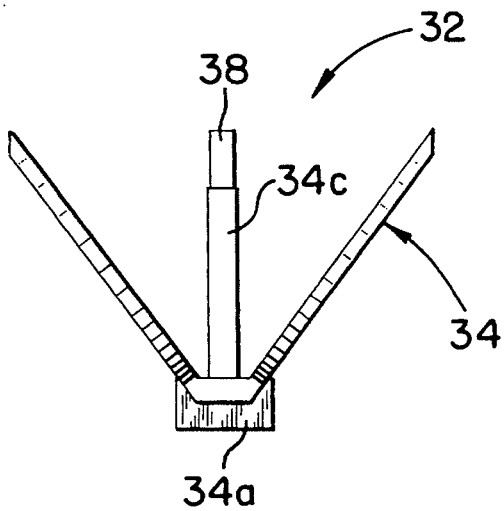
FIG. 5 is a bottom plan view of FIG. 4.
Figure 2:
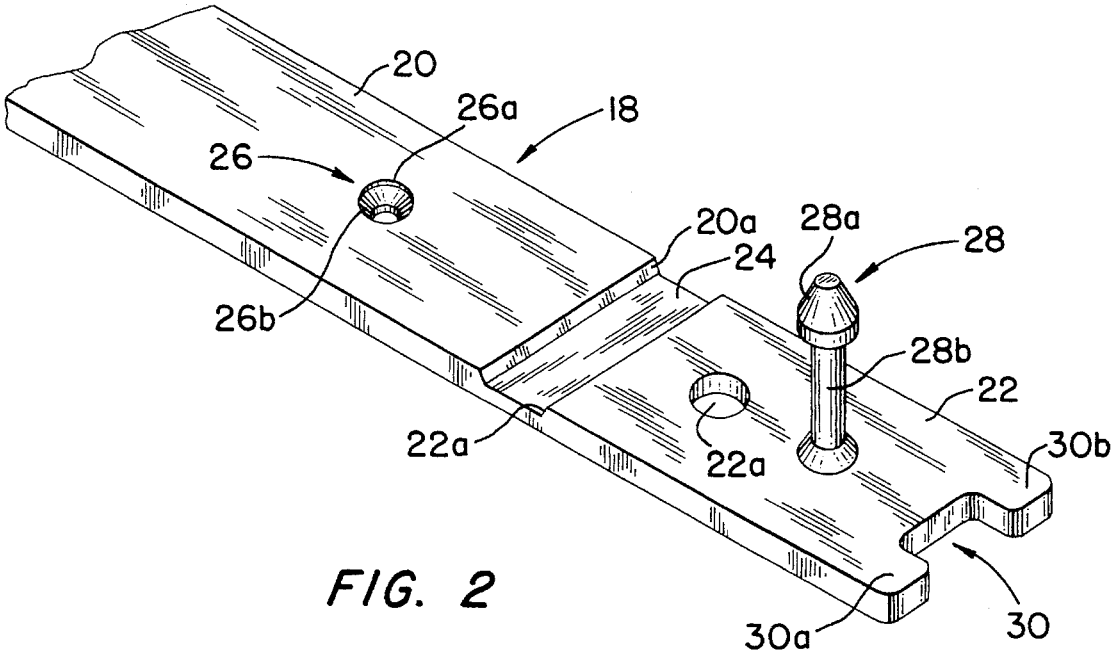
FIG. 2 is a view of the FIG. 1 folding tail hanger from one perspective.
Figure 3:
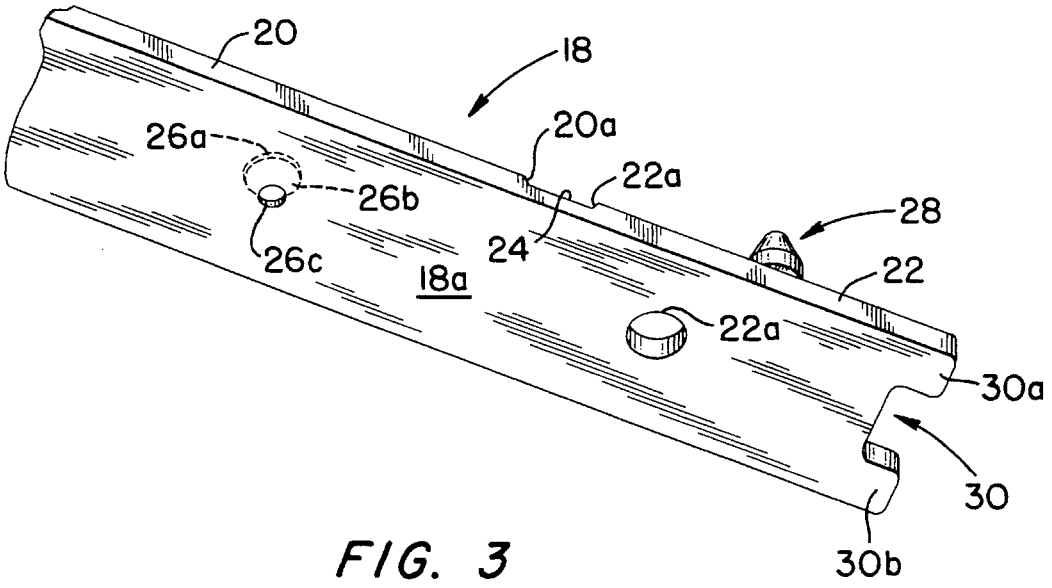
FIG. 3 is a view of the FIG. 1 folding tail hanger from another perspective.

Referring to FIGS. 1–3, folding tail hanger 10 is comprised of a one-piece plastic body having a hook 12 with entry opening 14, a display area 16 and a tail 18.

Tail 18 has upper portion 20 and lower portion 22 foldable about fold area 24, which is a thinned section of tail 18 and has tapered bounding walls 20*a* and 22*a*.

Upper portion 20 has latching opening 26 extending in first circular entry part 26*a*, in second conical part 26*b* between part 26*a* to the rear surface 18*a* of tail 18, and rearwardly of surface 182 in open third part 26*c*.

Lower portion 22 supports projection 28, which has an enlarged frustro-conical free end latching member 28*a* and a shank 28*b*. At its free end, lower portion defines a recess 30 bounded by walls 30*a* and 30*b*. Opening 22*a* extends through lower portion 22 and is located between projection 28 and fold area 24.

Turning to FIGS. 4–7, necktie knot support assembly 32 includes molded plastic part (necktie knot former) 34 and a metal spring unit.

Front portion 34*a* of necktie knot former 34 defines a vertically extending slot therethrough and has a retaining projection 34*b* disposed below the slot. A spacing projection 34*c* extends rearwardly of necktie knot former 34.

The metal spring unit includes a support member 36 having an opening 36*a*, side springs 36*b* and 36*c* and central spring 36*d*. Member 36 is inserted into the slot of front portion 34*a* of necktie knot former 34 and opening 36a receives projection 36*a* to be retained with the necktie knot former.

Figure 7:
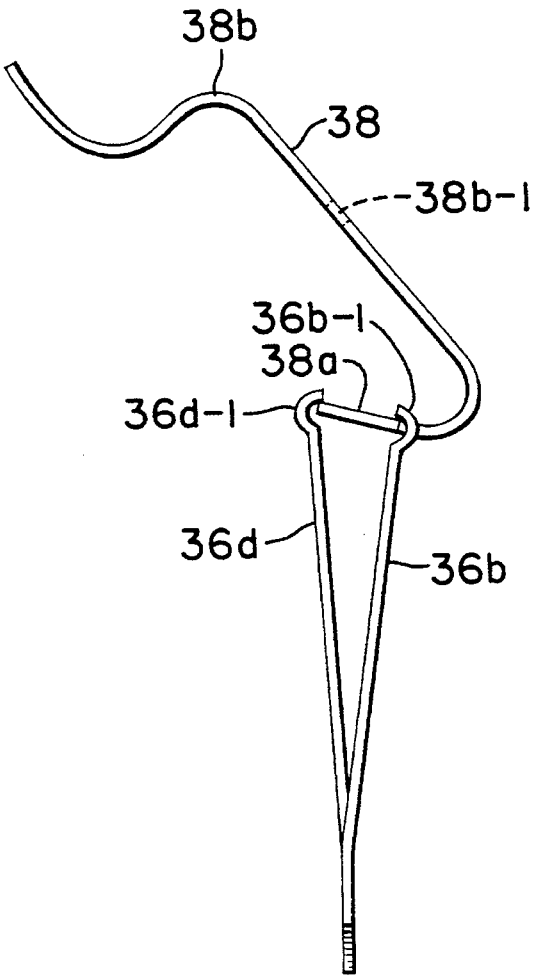
FIG. 7 is a left side view of FIG. 6.
Figure 6:
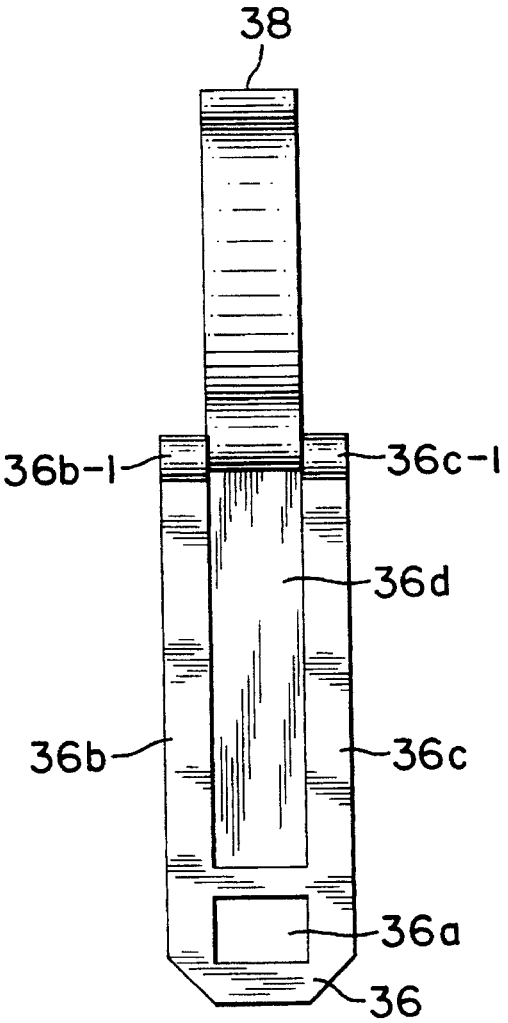
FIG. 6 is a front elevation of the spring member of the FIG. 4 necktie knot support assembly.

The metal spring unit also includes movable member 38 supported by support member 36 for snap action movement. One snap action position of movable member is depicted in FIG. 7, where wing 38*a* of the movable member is engaged by arcuate free end portion 36*b*-1 of side spring 36 and the central part of the movable member is engaged by arcuate free end portion 36*d*-1 of central spring 36*d*. While not shown, an opposite wing of movable member 38 is engaged by arcuate free end portion 36*c*-1 of side spring 36*c*.

As is known in the art, the other snap action position of movable member 38 is such that its wing portion 38*a* is vertically disposed and engaged by spring free end portions 36*b*-1, 36*c*-1 and 36*d*-1. In that position, movable member 38 has portion 38*b* thereof in facing relation to support member 36. Portion 38*b* has opening 38*b*-1 extending centrally therethrough for purposes below discussed.

In assembling hanger 10 with necktie knot support assembly 32, the hanger is inverted from its FIG. 1 disposition such that recess 30 faces upwardly. Assembly 32 is arranged in its FIG. 7 disposition, i.e., with movable member 38 portion 38*a* not in facing relation to support member 36. The hanger is moved upwardly, such that movable member 38 seats in recess 30. Projection 28 is then inserted into and through opening 38*b*-1. A subassembly is thus reached wherein, with the hanger not folded, necktie knot support assembly 32 is mounted on tail portion 22.

In a next and final assembly step, the hanger is folded such that tail portion 22 is moved into facing relation with tail portion 20 and projection 28 is forced into latching opening 26 to an extent whereby enlarged frustro-conical free end latching member 28*a* is forced beyond tail rear surface 18*a*.

Figure 8:
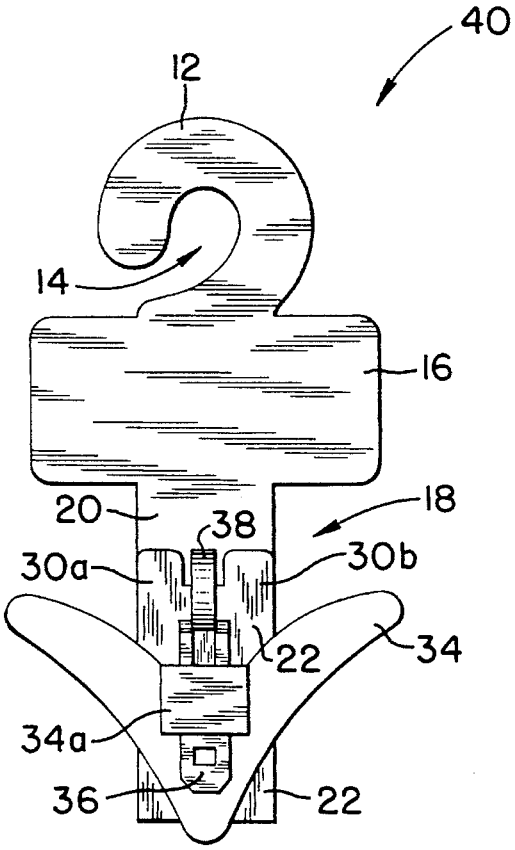
FIG. 8 is a front elevation of the folding tail hanger of FIGS. 1–3 assembled with the FIG. 4 necktie support assembly.
Figure 9:
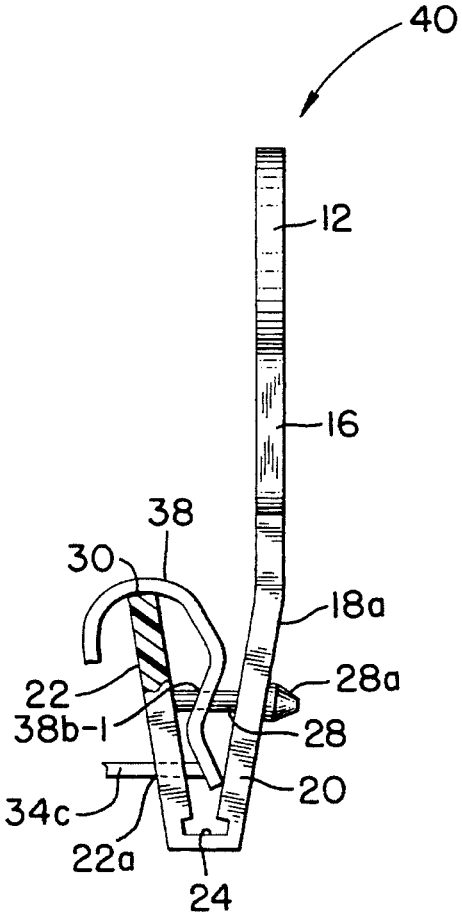
FIG. 9 is a partial right side view of FIG. 8, sectioned in part to show detail.

The ultimate assembly is shown in FIG. 8 and FIG. 9 shows a partial view of the assembly. As is seen, projection 28 has sufficient length, in excess of the prior art folding tail hanger projection, to accommodate both the function of providing hanging for the necktie knot support assembly and the function of retaining the assembly of folding tail hanger and the supported necktie knot support assembly.

A further feature of the invention and its FIG. 8 assembly is that the hanger is configured so as to impart preselected orientation to the hung necktie knot support assembly. Thus, with movable member 38 nested in hanger recess 30, the former is constrained to a horizontal disposition.

Various changes in structure to the described composite hanger and practices connected therewith may evidently be introduced without departing from the invention. Accordingly, it is to be understood that the particularly disclosed and depicted embodiment and practices are intended in an illustrative and not in a limiting sense. The true spirit and scope of the invention is set forth in the following claims.

What is claimed is:

1. A hanger composite including:

(a) a first hanger including a tail having first and second portions folded about a tail fold area to define a tail loop, said first tail portion having a latching opening therethrough, said second tail portion having a projection extending outwardly thereof and resident in said latching opening; and (b) a second hanger adapted for hanging neckwear and including a necktie support assembly, said second hanger having a portion thereof disposed retentively within said tail loop, said second hanger having a second portion disposed outwardly of said tail loop, said necktie support assembly comprising a necktie knot former and a metal spring unit.

2. The invention claimed in claim 1, wherein said first hanger second tail portion is configured to impart preselected orientation to said second hanger.

3. The invention claimed in claim 1, wherein said necktie knot former is a plastic molded component.

4. The invention claimed in claim 1, wherein said metal spring unit comprises a support member and a further member movably supported by said support member.

5. The invention claimed in claim 4, wherein said further member defines an opening, said second tail portion projection being resident in said further member opening.

6. A hanger composite including:

(a) a first hanger including a tail having first and second portions folded about a fold area therebetween to define a tail loop; and (b) a second hanger having a first portion thereof disposed retentively within said tail loop, said second tail portion having a free end defining a recess so as to impart preselected orientation to said second hanger, said second hanger having a second portion resident in said recess.

7. A hanger composite including:

(a) a first hanger including a tail having first and second portions folded about a fold area therebetween to define a tail loop, said first tail portion defining a latching opening therethrough and said second tail portion defining a projection extending outwardly of the tail portion to a given extent for latching disposition in the latching opening, and;

(b) a second hanger assembled with the first hanger, the second hanger having an opening therethrough, said second tail portion projection being resident in said second hanger opening.

8. The invention claimed in claim 7, wherein said second hanger is adapted for hanging neckwear.

9. The invention claimed in claim 7, wherein said first hanger second tail portion is configured to impart preselected orientation to said second hanger.

10. The invention claimed in claim 8, wherein said second hanger includes a necktie support assembly.

11. The invention claimed in claim 10, wherein said first hanger second tail portion is configured to impart preselected orientation to said necktie support assembly.

12. The invention claimed in claim 10, wherein said necktie support assembly comprises a necktie knot former and a metal spring unit.

13. The invention claimed in claim 12, wherein said metal spring unit comprises a support member and a further member movably supported by said support member, said second hanger opening extending through said further member.

* * * * *